US008613448B1

(12) United States Patent
Fraze

(10) Patent No.: US 8,613,448 B1
(45) Date of Patent: Dec. 24, 2013

(54) TACTILE SLIDE PUZZLE

(75) Inventor: Raymond E. Fraze, Hereford, AZ (US)

(73) Assignee: Playability Toys, LLC, Tucson, AZ (US)

( * ) Notice: Subject to any disclaimer, the term of this patent is extended or adjusted under 35 U.S.C. 154(b) by 24 days.

(21) Appl. No.: 13/346,374

(22) Filed: Jan. 9, 2012

Related U.S. Application Data

(60) Provisional application No. 61/433,038, filed on Jan. 14, 2011.

(51) Int. Cl.
*A63F 9/08* (2006.01)

(52) U.S. Cl.
USPC ..... 273/153 S

(58) Field of Classification Search
USPC ..... 273/157 R, 153 S
See application file for complete search history.

(56) References Cited

U.S. PATENT DOCUMENTS

| | | | | | |
|---|---|---|---|---|---|
| 2,462,502 | A | * | 2/1949 | Horwitz | 273/157 R |
| 2,948,535 | A | * | 8/1960 | Ellman | 273/157 R |
| 3,208,753 | A | * | 9/1965 | Stotts | 273/153 S |
| 3,332,687 | A | * | 7/1967 | Bennett | 273/157 R |
| 3,946,514 | A | * | 3/1976 | Joslyn | 273/153 S |
| 4,298,200 | A | * | 11/1981 | Kanbar | 273/157 R |
| 4,323,243 | A | * | 4/1982 | Hanson et al. | 273/153 S |
| 4,333,652 | A | * | 6/1982 | Clancy | 273/153 S |
| 4,436,307 | A | * | 3/1984 | Caldwell | 273/157 R |
| 4,470,601 | A | * | 9/1984 | Finn | 273/153 S |
| RE32,004 | E | * | 10/1985 | Clancy | 273/153 S |
| 4,725,061 | A | * | 2/1988 | Gross | 273/157 R |
| 4,735,417 | A | * | 4/1988 | Gould | 273/153 S |
| 4,793,615 | A | * | 12/1988 | Martin | 273/153 S |
| 4,796,891 | A | * | 1/1989 | Milner | 273/153 S |
| 4,880,384 | A | | 11/1989 | Murphy | 434/113 |
| 5,205,557 | A | * | 4/1993 | Kuo | 273/153 S |
| 5,267,732 | A | * | 12/1993 | Bowen et al. | 273/153 S |
| 5,389,063 | A | * | 2/1995 | Wu | 601/135 |
| 5,391,078 | A | | 2/1995 | Murphy | 434/113 |
| 5,687,970 | A | * | 11/1997 | Clark | 273/264 |
| 5,735,521 | A | * | 4/1998 | Klimpert | 273/157 R |
| 5,775,693 | A | * | 7/1998 | Clancy | 273/153 S |
| 5,785,318 | A | * | 7/1998 | Nesis | 273/153 S |
| 5,820,377 | A | | 10/1998 | Murphy et al. | 434/113 |
| 5,836,584 | A | * | 11/1998 | Chen | 273/153 S |
| 5,947,473 | A | * | 9/1999 | Spitzer | 273/153 S |
| 6,162,059 | A | * | 12/2000 | Murphy et al. | 434/112 |
| 6,857,632 | B2 | * | 2/2005 | Tanner | 273/153 S |
| 7,243,918 | B2 | * | 7/2007 | Vernon | 273/153 S |
| 2011/0316230 | A1 | * | 12/2011 | Bassett | 273/157 R |

OTHER PUBLICATIONS

Popular Playthings Learning Mates "Twist 'N Slide" Item #2010x print out (http://www.huntarcompany.com/mm5/merchant.mvc?Screen=PROD& . . .) (1 pg).

* cited by examiner

*Primary Examiner* — Steven Wong
(74) *Attorney, Agent, or Firm* — Hayes Soloway P.C.

(57) ABSTRACT

A tactile slide puzzle comprises a puzzle support structure, and a plurality of pieces that are slidably disposed on or within the puzzle support structure. The plurality of pieces, when properly configured, form a completed puzzle having a plurality of shapes which protrude outwardly from a surface of said plurality of pieces. Each of said sliding pieces includes a portion of at least one of said plurality of shapes, and each of said plurality of shapes has a textured top surface. The slide puzzle may further include a solution key disposed on the slide puzzle, and the solution key has the same tactile feel as does the completed puzzle. An audible or visual indicator may be included to provide an indication that the puzzle has been properly completed.

9 Claims, 4 Drawing Sheets

TACTILE SLIDE PUZZLE

CROSS REFERENCE TO RELATED APPLICATIONS

This application claims priority to U.S. Provisional Appln. Ser. No. 61/433,038, filed Jan. 14, 2011, the contents of which are incorporated herein by reference.

FIELD OF THE INVENTION

The present invention relates to a puzzle, in particular, a tactile slide puzzle that may be completed based solely on tactile feel. The invention has particular utility for developing visual stimulation, visual awareness, tactile stimulation, problem solving, logic skills, fine motor skills and hand/eye coordination, particularly for individuals with visual impairments. The invention will be described in connection with such utility, although other utilities are contemplated.

BACKGROUND OF THE INVENTION

As discussed in the background section of U.S. Pat. No. 6,162,059 to Murphy et al., a number of systems have been developed to facilitate communication with or teaching of visually impaired individuals using a tactile recognition language, including Braille. For example, the TACK-TILES® Braille System, described in U.S. Pat. Nos. 4,880,384; 5,391,078; and 5,820,377, includes a system of blocks having Braille characters that may be interchangeably attached to a slate to create words, sentences, paragraphs and other expressions. However, as explained in U.S. Pat. No. 6,162,059, many visually impaired individuals do not have the opportunity to develop the problem solving and analytical skills, through the use of, e.g., puzzles or other games, as do non-visually impaired individuals.

Thus, U.S. Pat. No. 6,162,059 provides a puzzle for helping visually impaired individuals develop problem solving or analytical skills. The puzzle includes a supporting board on which a plurality of sliding pieces is disposed. One sliding piece is missing, thereby creating a blank space so that the remaining pieces can be aligned to form a particular sequence, such as arranging the pieces in a sequence to spell out the alphabet in Braille, or to spell a particular word in Braille. A tactilely recognizable region is disposed on each of the pieces, which may be a Braille character.

However, while it may be beneficial as a development tool for the visually impaired, the puzzle disclosed by U.S. Pat. No. 6,162,059 generally requires the user to understand Braille in order to solve the puzzle and generally enjoy using the puzzle. Moreover, each piece of the puzzle contains a certain Braille character, for example a number or a letter, and thus solving the puzzle comprises putting the Braille characters into a certain specific order to spell out a word or other sequence. As such, the puzzle requires a certain understanding of language in order to be completed and enjoyed. Furthermore, there is no solution key provided so that a user can confirm that the puzzle has been properly completed.

Thus, there remains a need in the field for a tactile slide puzzle that can be completed by a visually impaired individual and that does not require an understanding of language or Braille. There is a further need in the field for such a tactile slide puzzle that can be completed based only on the tactile feel provided on a number of slidable pieces. Moreover, there remains a need in the field for a tactile slide puzzle that includes a mechanism for confirming that the puzzle has been properly completed.

SUMMARY OF THE INVENTION

The present disclosure is directed to a tactile slide puzzle that overcomes the aforesaid and other disadvantages of the prior art. More particularly, the present disclosure provides a tactile slide puzzle that includes a plurality of slidable pieces that, when properly configured, form a completed puzzle having a plurality of shapes which protrude outwardly, and each of the shapes has a top surface which is textured at least in part.

In one aspect, the present disclosure provides a slide puzzle that includes a puzzle support structure; and a plurality of pieces that are slidably disposed on or within the puzzle support structure. The plurality of pieces, when properly configured, form a completed puzzle having a plurality of shapes which protrude outwardly from a surface of said plurality of pieces, each of said sliding pieces includes a portion of at least one of said plurality of shapes, and each of said plurality of shapes has a top surface that is textured at least in part. The slide puzzle may further include a solution key disposed on the slide puzzle, and the solution key has the same tactile feel as does the completed puzzle.

In another aspect, the present disclosure provides a tactile slide puzzle that includes a plurality of slidable puzzle pieces; and a solution key, wherein said solution key has the same tactile feel as does the plurality of slidable puzzle pieces when properly configured.

Each of said plurality of pieces may be tactilely unique, and a handle may be included for carrying the puzzle.

In yet a further aspect provided by the present disclosure, an audible indicator may be included which produces an audible indication when the puzzle has been properly completed. Alternatively, or in addition, a visual indicator which produces a visual indication when the puzzle has been properly completed may be included.

The slide puzzle may have a high-contrast color pattern such that it can be better seen by individuals having limited vision.

The puzzle support structure may include an opening in which an inner board is disposed such that a top surface of the inner board is substantially flush with a top surface of the support structure and a loop of empty space is formed between an outer edge of said inner board and an inner edge of said support structure. The inner board may include a plurality of projections which form therebetween columns of empty space, wherein said loop of empty space and said columns of empty space are coupled to form a track around which each of said plurality of pieces may slide.

Moreover, each of said plurality of pieces may include an engaging member which extends through the track, thereby slidably securing each piece in the track. Each of said plurality of pieces may be rotatable by 360°.

Accordingly, an advantage of the present disclosure is to provide a tactile slide puzzle that can be completed and enjoyed by a visually impaired individual, without requiring an understanding of language and/or Braille. Furthermore, an advantage of the present disclosure is to provide a mechanism to confirm that the puzzle has been properly completed. The mechanism may be a tactile solution key, an audible indicator or a visual indicator.

The features, functions and advantages that have been discussed can be achieved independently in various embodiments of the present disclosure or may be combined in yet other embodiments, further details of which can be seen with reference to the following descriptions and drawings.

BRIEF DESCRIPTION OF THE DRAWINGS

Further features and advantages of the invention will be seen from the following detailed description, taken in conjunction with the accompanying drawings, wherein like numerals depict like parts, and wherein.

DETAILED DESCRIPTION

In the following description, reference is made to the accompanying drawings, which form a part hereof, and in which is shown, by way of illustration, various embodiments of the present disclosure. It is understood that other embodiments may be utilized and changes may be made without departing from the scope of the present disclosure.

Figure 1:
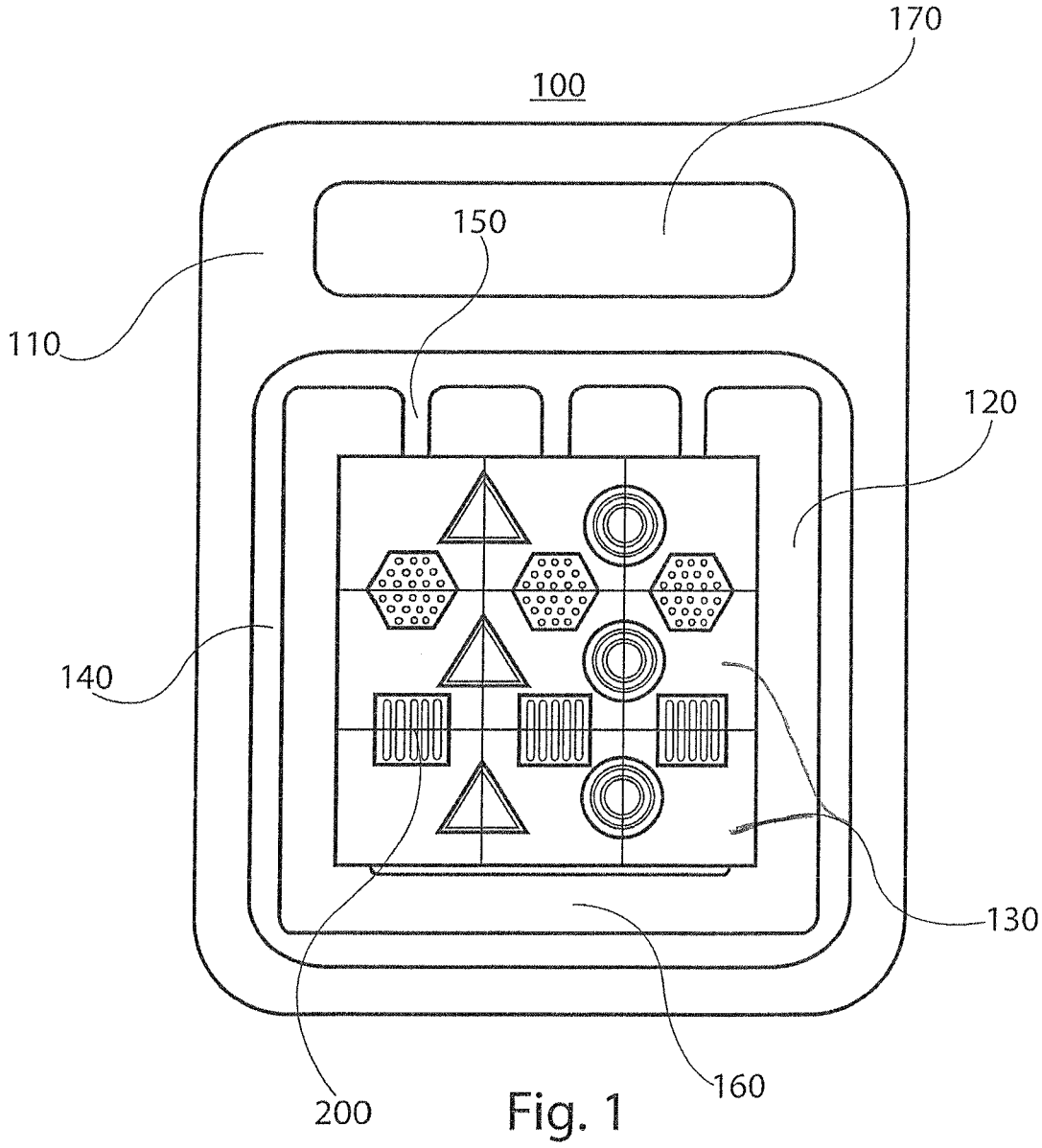
FIG. 1 illustrates a tactile slide puzzle in a completed configuration, in accordance with an embodiment of the present disclosure.

FIG. 1 illustrates a primary example of a tactile slide puzzle 100 provided by the present invention. The puzzle 100 comprises a support board 110 and an inner board 120. The inner board 120 is disposed within a cut-out or recessed area of the outer board 110, and joined to an inner surface within the recessed area. The outer surfaces of both the support board 110 and the inner board 120 are substantially flush with one another. A space between the inner board 120 and the support board 110 forms an outer loop 140 for the puzzle. The inner board 120 has a number of projections, or fingers, thereby forming columns 150 of empty space between the fingers. The outer loop 140 and the columns 150 are coupled to each other to form a track around which the puzzle pieces 130 may slide. A handle 170 may be formed within or connected to the support board 110 for carrying the puzzle by hand.

Puzzle pieces 130 are provided which are slidably secured to the board, for example, by an engaging member that extends through the empty space provided by outer loop 140 and columns 150, and engages a back surface of the inner board 120 and/or the support board 110. As depicted in FIG. 1, nine puzzle pieces 130 are provided which, when properly aligned, form a 3×3 grid. However, any other number of puzzle pieces may be employed by the present invention.

The puzzle pieces 130 each contain a portion of at least one shape 200. As pictured in FIG. 1, the shapes may include triangles, hexagons, circles and/or squares, although other such shapes, symbols, characters and portions of a picture may be employed on the puzzle pieces of the present invention. The shapes 200 are raised, i.e. they protrude outwardly from the surface of the puzzle pieces 130. Because the shapes 200 are raised from the surface of the puzzle pieces 130, and because each puzzle piece 130 contains a portion of at least one shape 200, a visually impaired or blind person can complete the puzzle by arranging each puzzle piece 130 into its appropriate spot based on the tactile feel of the portion of the shapes 200 provided on each puzzle piece 130. Preferably, the shapes 200 have a high-contrast color pattern. For example, the hexagons and the squares of the puzzle depicted in FIG. 1 may be red, while the triangles and circles may be black. Additionally, the support board 110 may be black, while the inner board 120 may be red. The high-contrast color pattern makes the puzzle 100 easier to see for individuals with limited sight.

Furthermore, the top surfaces of the shapes 200 are further textured to provide additional tactile stimuli. For example, as can be seen from FIG. 1, the triangles have raised lines around an inner perimeter of the triangle, and a raised line bisecting the triangle; the hexagons have bumps which protrude outwardly from the top surface; the squares have raised parallel lines; and the circles have two or more raised concentric circles of different radii.

Figure 2:
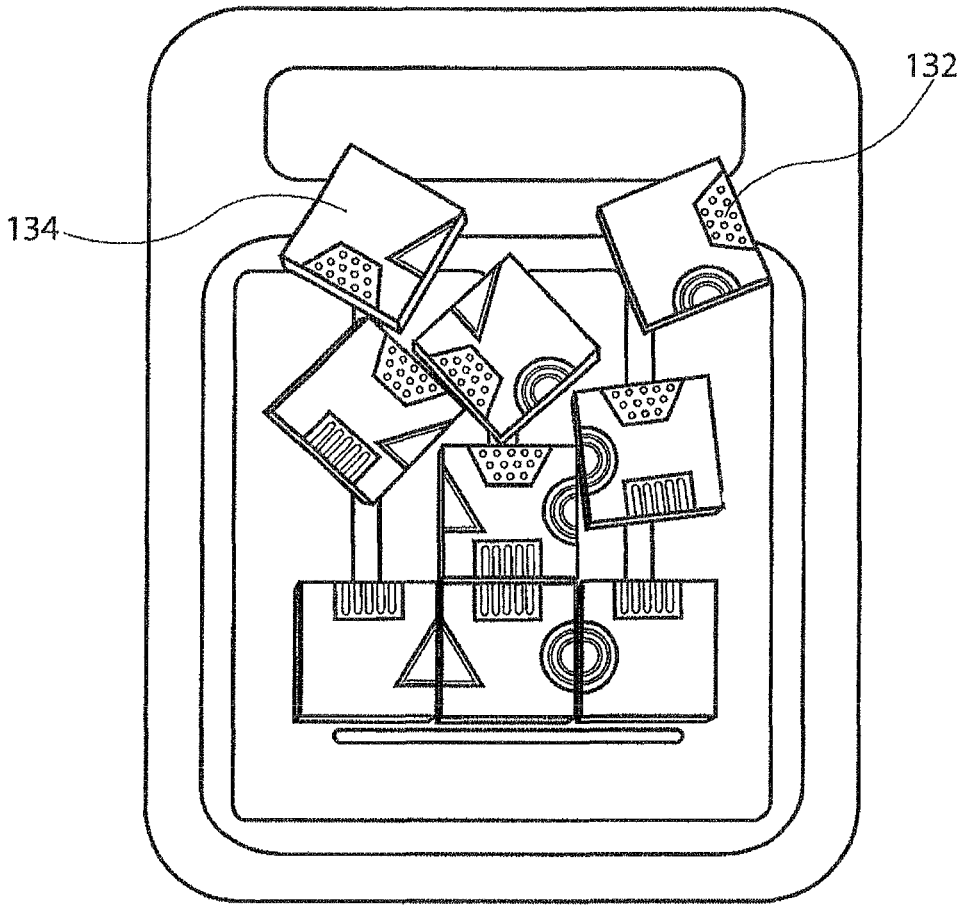
FIG. 2 illustrates a tactile slide puzzle in an incomplete configuration, in accordance with the present disclosure.

FIG. 2 shows the tactile slide puzzle 100 with the pieces 130 in various positions. For example, pieces 132 and 134 are shown in the outer loop 140, while the other pieces are generally shown within one of the columns 150. In addition to being capable of sliding around the loop 140 and into columns 150, the pieces 130 may further be rotatable by up to 360°. For example, in FIG. 2 the pieces 130 are shown in various stages of rotation.

The completed puzzle is shown in FIG. 1. The puzzle 100 can be arbitrarily rearranged to an initial position by sliding the pieces 130 to various positions in the columns 150 and/or the outer loop 140. Then, beginning from such an arbitrary or random position, the puzzle may be completed by sliding the tiles one at a time into their correct position.

Figure 3:
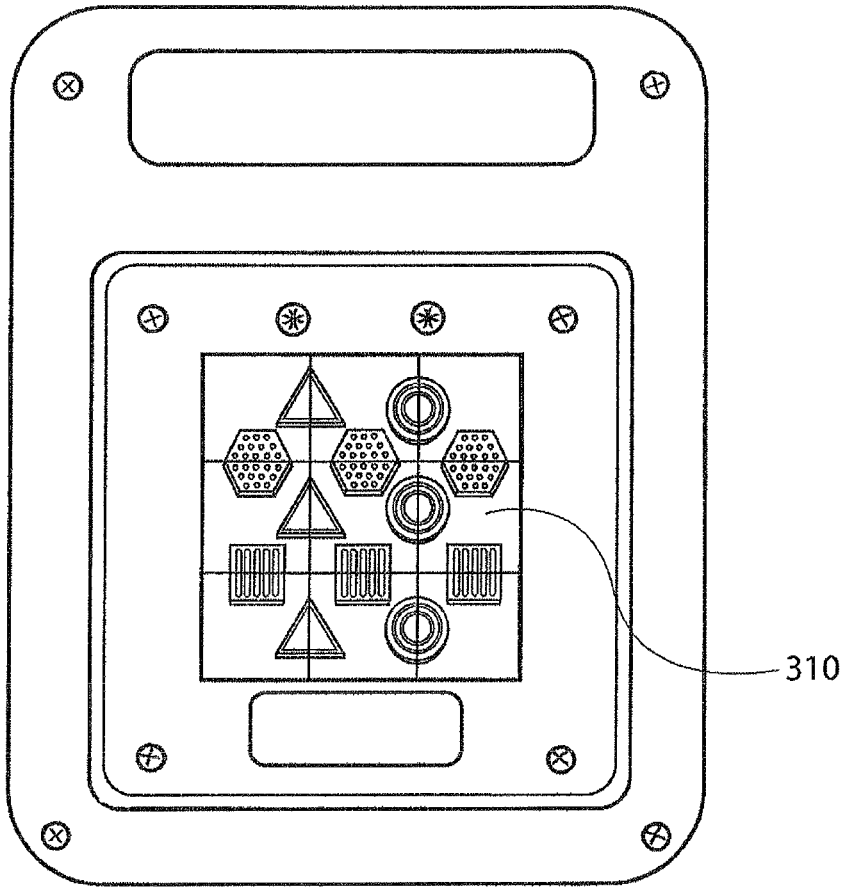
FIG. 3 illustrates a solution key provided on a hack surface of a tactile slide puzzle, in accordance with a further aspect provided by the present disclosure.

As shown in FIG. 3, a solution key of the completed puzzle is provided on the back side of the support board 110. The solution key has the same tactile feel as does the puzzle when each of the pieces 130 is properly configured. That is, the solution key 310 includes the flat surface of the puzzle pieces 130, the raised shapes 200 on the puzzle pieces and the additional raised textures on the top surface of the shapes 200. Alternatively, a solution key may be provided separate and apart from the puzzle.

Figure 4:
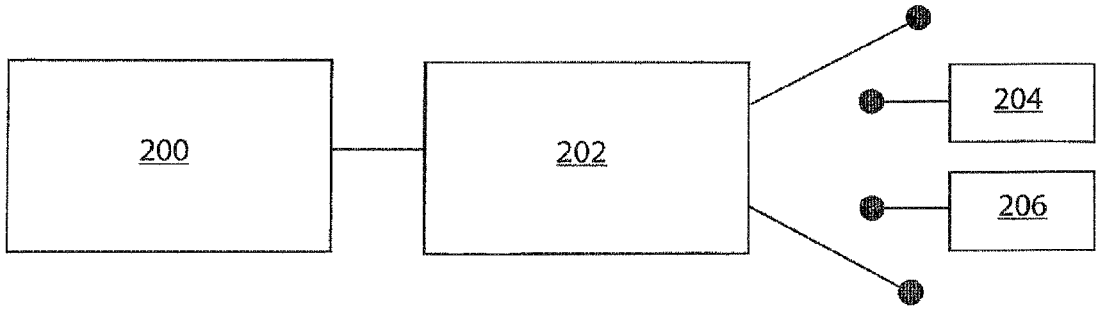
FIG. 4 schematically illustrates an electronic circuit for providing an audible or visual indicator when a puzzle is completed.

Referring also to FIG. 4, the puzzle 100 optionally may include an electronic circuit for providing an audible and/or visual indication that the puzzle has been successfully completed. Such a circuit could readily be constructed by one having ordinary skill in the relevant art. For example, the circuit may include a battery 200, disposed within a battery compartment in the support board 110, which powers control circuitry 202 for providing an indication that the puzzle has been completed, e.g., an audible tone or message transmitted through a speaker 204 which may be provided within the support board 110, and/or a visual indication by causing an LED or other light source 206 which may be provided within the support board 110 to flash. The audible and/or visual indicator provides additional confirmation to the puzzle user, for example a visually impaired child, that the puzzle has been successfully completed.

As described throughout the present disclosure, the puzzle 100 has particular utility for visually impaired individuals. For example, the raised pattern and tactile feel of each shape 200, bridging two tiles, allows an individual to tactilely identify each puzzle piece 130, and to determine where it belongs in the puzzle by matching the tactile feel of each piece 130 to the tactile feel of the appropriate adjacent pieces. Additionally, the high-contrast colors make the puzzle ideal for those with limited to no vision. Some of the developmental benefits of the puzzle include visual stimulation, visual awareness, tactile stimulation, problem solving, logic skills, fine motor skills and hand/eye coordination.

The puzzle pieces 130 are depicted in the drawings as having a square or rectangular shape; however, the pieces may be formed of any shape, such as triangles, hexagons, octagons, or any other shape. Moreover, while the present invention has generally been described herein as a slide puzzle employing rotatable pieces 130 within a support board 110 and an inner board 120 with an outer loop 140 and columns 150 for manipulating the pieces, the puzzle 100 may alternatively be formed as any other type of slide puzzle which may be known. For example, the puzzle may employ a plurality of sliding puzzle pieces 130 with one blank space so the remaining pieces can be shifted into the proper position (for example, as disclosed by U.S. Pat. No. 6,162,059).

Various changes may be made in the invention without departing from the spirit and the scope thereof. It should be emphasized that the above-described embodiments of the present tactile slide puzzle are merely possible examples of implementations and are merely set forth for a clear understanding of the principles of the invention. Many different embodiments of the tactile slide puzzle described herein may be designed and/or fabricated without departing from the spirit and scope of the invention. All these and other such modifications and variations are intended to be included herein within the scope of this disclosure and protected by the following claims. Therefore the scope of the invention is not intended to be limited except as indicated in the appended claims.

What is claimed is:

1. A slide puzzle for a visually impaired individual comprising:

a puzzle support structure; and a plurality of pieces slidably disposed on or within the puzzle support structure, wherein said plurality of pieces, when properly configured, form a completed puzzle having a plurality of shapes which protrude outwardly from a surface of said plurality of pieces, each of said sliding pieces includes a portion of at least one of said plurality of shapes, and each of said plurality of shapes has a top surface that is textured at least in part, said slide puzzle further comprising a solution key having the same tactile feel completed puzzle, disposed on a back of said puzzle, and an audible indicator which produces an audible indication when the puzzle has been properly completed.

2. The slide puzzle of claim 1, wherein each of said plurality of pieces is tactilely unique.

3. The slide puzzle of claim 1, further comprising a handle for carrying said puzzle.

4. The slide puzzle of claim 1, further comprising a visual indicator which produces a visual indication when the puzzle has been properly completed.

5. The slide puzzle of claim 1, wherein said puzzle has a high-contrast color pattern.

6. The slide puzzle of claim 1, wherein said puzzle support structure includes an opening in which an inner board is disposed such that a top surface of the inner board is substantially flush with a top surface of the support structure and a loop of empty space is formed between an outer edge of said inner board and an inner edge of said support structure, said inner board includes a plurality of projections which form therebetween columns of empty space, wherein said loop of empty space and said columns of empty space are coupled to form a track around which each of said plurality of pieces may slide.

7. The slide puzzle of claim 6, wherein each of said plurality of pieces includes an engaging member which extends through said track, thereby slidably securing each piece in the track.

8. The slide puzzle of claim 7, wherein each of said plurality of pieces are rotatable by 360°.

9. The slide puzzle of claim 1, further comprising a solution key having the same tactile feed as the completed puzzle, disposed apart from said puzzle.

* * * * *